US010633170B2

(12) United States Patent
Slooff et al.

(10) Patent No.: US 10,633,170 B2
(45) Date of Patent: Apr. 28, 2020

(54) RESEALABLE CONTAINER INCLUDING INSERT

(71) Applicant: PHILIP MORRIS PRODUCTS S.A., Neuchâtel (CH)

(72) Inventors: Arjen Hamilcar Slooff, Oosterbeek (NL); Timothee Cailleaux, Divonne-les-Bains (FR)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/770,320

(22) PCT Filed: Sep. 21, 2016

(86) PCT No.: PCT/IB2016/055631
§ 371 (c)(1),
(2) Date: Apr. 23, 2018

(87) PCT Pub. No.: WO2017/072607
PCT Pub. Date: May 4, 2017

(65) Prior Publication Data

US 2018/0305113 A1 Oct. 25, 2018

(30) Foreign Application Priority Data

Oct. 26, 2015 (EP) ..... 15191538

(51) Int. Cl.
*B65D 85/10* (2006.01)
*B65D 5/42* (2006.01)

(52) U.S. Cl.
CPC ..... *B65D 85/1045* (2013.01); *B65D 5/4233* (2013.01); *B65D 85/1081* (2013.01); *B65D 2203/00* (2013.01)

(58) Field of Classification Search
CPC .. B65D 2203/00; B65D 5/4233; B65D 75/54; B65D 77/28; B65D 85/1045; B65D 85/1081
See application file for complete search history.

(56) References Cited

U.S. PATENT DOCUMENTS 5,236,084 A * 8/1993 Evers ..... B65D 5/422 206/271
2005/0130822 A1* 6/2005 Rath ..... B65D 75/5827 493/309

(Continued)

FOREIGN PATENT DOCUMENTS

CN 102666304 A 9/2012
CN 103269954 A 8/2013

(Continued)

OTHER PUBLICATIONS

Extended European Search Report, issued by the European Patent Office, for EP 15191538.6, dated Feb. 11, 2016; 7 pgs.

(Continued)

*Primary Examiner* — Mollie Impink
(74) *Attorney, Agent, or Firm* — Mueting, Raasch & Gebhardt, P.A.

(57) ABSTRACT

A container comprises a housing 12 that comprises a box 14 and a lid 20 that is hingedly attached to the box. The lid 20 comprises a front wall 24 that has an inner surface 22, an outer surface 26 and a bottom edge. The box comprises a front wall 16 that has an upper edge 21 and an access region 62. At least some portion of the upper edge 21 of the box is formed by at least some portion of the access region 62. The container also comprises an inner package 30 disposed at least partially within the housing and at least partially defining an interior volume for housing consumer goods. The inner package 30 comprises a first layer 40 and a second layer 50. The first layer 40 comprises a flap 44 which is (Continued)

attached to the inner surface of the lid and is configured to be releasably attached to a sealing region 72 of the second layer 50 to open and close the inner package by opening and closing the lid of the container. The container also comprises an insert 60 positioned between the inner surface 17 of the front wall 16 of the box and the outer surface 32 of the front wall 31 of the inner package. The insert 60 has an upper edge 35 which is accessible via the access region 62.

14 Claims, 3 Drawing Sheets

(56) References Cited

U.S. PATENT DOCUMENTS

| | | | | |
|---|---|---|---|---|
| 2011/0147443 | A1 | 6/2011 | Igo | |
| 2012/0006823 | A1* | 1/2012 | Bertuzzi | B65D 75/5838 220/270 |
| 2013/0277249 | A1* | 10/2013 | Holford | B65D 5/548 206/264 |
| 2013/0319886 | A1 | 12/2013 | Ledermann | |

FOREIGN PATENT DOCUMENTS

| | | | |
|---|---|---|---|
| CN | 104507823 | A | 4/2015 |
| WO | WO 2011/054419 | A1 | 5/2011 |
| WO | WO 2015/045070 | A1 | 5/2011 |
| WO | WO 2014/013468 | A2 | 1/2014 |
| WO | WO 2015/011621 | A1 | 1/2015 |

OTHER PUBLICATIONS

International Search Report and Written Opinion for PCT/IB2016/055631, issued by the European Patent Office, dated Nov. 28, 2016; 11 pgs.

International Preliminary Report on Patentability for PCT/IB2016/055631, issued by the European Patent Office, dated Oct. 17, 2017; 13 pgs.

Chinese Office Action for CN 201680058865.0 issued by the China National Intellectual Property Administration dated May 28, 2019, including English Translation; 10 pgs.

* cited by examiner

RESEALABLE CONTAINER INCLUDING INSERT

This application is the § 371 U.S. National Stage of International Application No. PCT/IB2106/055631, filed 21 Sep. 2016, which claims the benefit of European Application No. 15191538.6, filed 26 Oct. 2015, the disclosures of which are incorporated by reference herein in their entireties.

The present invention relates to a resealable container for consumer goods that includes an accessible insert. The container finds particular application as a container for elongate smoking articles such as cigarettes.

It is common in the industry to use inserts as a means of communication.

WO 2015/011621 shows a resealable pack that includes an insert, but the insert has a shape (at its top) that mirrors an offset seal on the lid. The mirrored portion of the insert affords a tab with which to gain access to the insert. Such a configuration would require the container and methods of making the container to be drastically modified.

WO 2015/045070 provides an inner liner with a fin seal across the front wall that creates a pocket on the front wall of the container to hold an insert. The pocket limits the size of the insert significantly.

With the above-discussed containers, as well a typically utilized resealable containers and more specifically automatically resealable containers, use of an insert is not possible because there is no space available to access additional components, like an insert.

One object of the invention is to provide a container that both affords automatic opening and resealing of an inside sealed package upon opening the outer lid and access to an insert.

In one aspect of the present invention, a container is described. The container comprises a housing that comprises a box and a lid that is hingedly attached to the box. The lid comprises a front wall that has an inner surface, an outer surface and a bottom edge. The box comprises a front wall that has an upper edge and an access region. At least some portion of the upper edge of the box is formed by at least some portion of the access region. The container also comprises an inner package disposed at least partially within the housing and at least partially defining an interior volume for housing consumer goods. The inner package comprises a first layer and a second layer. The first layer comprises a flap which is attached to the inner surface of the lid and is configured to be releasably attached to a sealing region of the second layer to open and close the inner package by opening and closing the lid of the container. The container also comprises an insert positioned between the inner surface of the front wall of the box and the outer surface of the front wall of the inner package. The insert has an upper edge which is accessible via the access region.

In other aspects of the present invention, the entire insert is positioned below the bottom edge of the lid when the container is closed. In some aspects, the access region of the insert can include a line of weakness in the front wall of the box and a tear away region defined by that line of weakness. In some aspects, the tear away region can be removed from the container along with the insert or it can remain with the container.

Various aspects of the present invention may provide one or more advantages relative to currently—available or previously—described containers. For example, the present containers combine the feature of being automatically resealable with the use of inserts, which up until the present invention were unable to be combined. Furthermore, the present containers afford the combination of these two features but do not sacrifice proper functionality of the automatic closure of the inner feature.

The present invention is applicable to any suitable container for consumer goods such as for example elongate smoking articles. It is known to package consumer goods such as, for example, elongate smoking articles in containers formed from folded laminar blanks. For example, elongate smoking articles, such as cigarettes and cigars, are commonly sold in hinge lid packs having a box for housing the smoking articles and a lid connected to the box about a hinge line extending across the back wall of the container.

The container may take any suitable form for housing consumer goods. For example, as already mentioned, the container may comprise a housing that can be described as a hinge-lid container having one or more hinged lids connected to a box housing the consumer goods. In one or more embodiments, the container may be a slide and shell container having an inner slide for housing the consumer goods mounted within an outer shell. Where the container is a slide and shell container, the outer shell or the inner slide may include one or more hinge lids. The container may be formed from any suitable materials including, but not limited to, cardboard, paperboard, plastic, metal, other materials, or combinations thereof. The cardboard may have a weight of between about 100 grams per square meter and about 350 grams per square meter.

Containers described herein will generally have the same or a similar shape as the housing. As such, housings according to the invention may be in the shape of a rectangular parallelepiped, with right-angled longitudinal and right-angled transverse edges. Alternatively, the housing may comprise one or more rounded longitudinal edges, rounded transverse edges, bevelled longitudinal edges, or bevelled transverse edges, other types of edges, or combinations thereof. For example, the housing according to the invention may comprise, without limitation, one or more of the following features:

- one or two longitudinal rounded or bevelled edges on at least one of the front wall and the back wall;
- one or two transverse rounded or bevelled edges on at least one of the front wall and the back wall;
- one longitudinal rounded edge and one longitudinal bevelled edge on the front wall, or one transverse rounded edge and one transverse bevelled edge on the back wall;
- one longitudinal rounded edge and one longitudinal bevelled edge on the front wall, and one transverse rounded edge and one transverse bevelled edge on the back wall;
- one or two transverse rounded or bevelled edges on the front wall and one or two longitudinal rounded or bevelled edges on the front wall; and
- two longitudinal rounded or bevelled edges on a first side wall or two transverse rounded or bevelled edges on the second side wall.

Where the housing comprises one or more rounded edges, preferably the blanks forming the housing comprise three, four, five, six, or seven scoring lines or creasing lines to form each rounded edge in the assembled container. The scoring lines or creasing lines may be either on the inside of the housing or on the outside of the housing. Preferably, the scoring lines or creasing lines are spaced from each other by between about 0.3 millimetres (mm) and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the housing comprises one or more bevelled edges, preferably the bevelled edge has a width of between about 1 mm and about 10 mm, preferably between about 2 mm and about 6 mm. In one or more embodiments, the housing may comprise a double bevel formed by three parallel creasing or scoring lines that are spaced such that two distinct bevels are formed on the edge of the container. Where the housing comprises a bevelled edge, the bevel may be formed by two parallel creasing lines or scoring lines in the laminar blank from which the container is formed. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the housing.

Alternatively, the housing may have a non-rectangular transverse cross section, for example, polygonal such as triangular or hexagonal, or oval, semi-oval, circular or semi-circular.

Containers according to the invention find particular application as packs for elongate smoking articles such as, for example, cigarettes, cigars or cigarillos. In other embodiments, the consumer goods may be aerosol-generating articles such as articles that heat but not burn tobacco. It will be appreciated that through appropriate choices of the dimensions thereof, containers according to the invention may be designed for different numbers of conventional size, king size, super-king size, slim or super-slim cigarettes. Through an appropriate choice of the dimensions thereof, containers or housings according to the invention may be designed to hold different total numbers of smoking articles, or different arrangements of smoking articles. For example, through an appropriate choice of the dimensions thereof, containers or housings according to the invention may be designed to hold a total of between ten and thirty smoking articles.

As well as housing a bundle of smoking articles, the container may further comprise other consumer goods, for example, matches, lighters, extinguishing means, breath-fresheners, or electronics. The other consumer goods may be attached to the outside of the container, contained within the container along with the smoking articles, in a separate compartment of the container, or any combination thereof.

Disclosed containers comprise a housing. The housing has an inner surface and an outer surface. The housing also has a rear wall, a front wall and two side walls. The housing comprises a lid and a box.

The lid of the housing is hingedly attached to the box and is adapted to be manipulated between an open position and a closed position. In the open position, the consumer can access the consumer goods disposed within the housing. The lid is hingedly attached to the box along a hinge line that extends across the rear wall or the upper edge of the rear wall of the housing. A hinge line may be, for example, a fold line or a score line in the panel forming the back wall of the housing. The lid and box are further defined by an opening line. The opening line refers to the delineation between the lid and the box which begins at one end of the hinge line traverses the right side of the housing, the front of the housing then the left side of the housing, or vice versa, and ends at the other end of the hinge line.

Preferably, the lid comprises a lid front wall, a lid left side wall, a lid right side wall, a lid back wall, and a lid top wall. The lid has an inner surface and an outer surface. The front wall of the lid also has a bottom edge.

Preferably, the box comprises a box front wall, a box left side wall, a box right side wall, a box back wall, and a box bottom wall. The box has an inner surface and an outer surface. The front wall of the box has an upper edge, which when closed at least partially meets the bottom edge of the lid.

The box also comprises an access region. The access region is generally located along the upper edge of the box. Preferably, at least a portion of the access region is disposed at least partially along the upper edge of the box. The access region can comprise a cut-out or notched out portion of the front wall of the box. The access region can alternatively comprise a line of weakness and a portion of the front wall of the box that can be removed once the line of weakness has been broken.

Some access regions can comprise a cut-out, a notch out or a void in the front wall of the box. Such access regions function by allowing egress and ingress to the insert via the access region without any further action. Such access regions can take virtually any shape. For example, the access region can have a semi-circular shape, a circular shape, a triangular shape, an oval shape, a semi-oval shape, a rectangular shape, a square shape, an irregular shape, any other shape, or any combination thereof. Regardless of the shape of the access region, an upper edge of the access region follows or makes up a portion of the upper edge of the box.

Some access regions can comprise a line of weakness and a portion of the front wall of the box bordered by the line of weakness, referred to as the tear away portion. The line of weakness can define the shape of such access regions. Such access regions function by allowing access to the insert via perforation of the line of weakness and removal of the tear away portion. Such access regions, lines of weakness, or both can take virtually any shape. For example the access region or more specifically, the line of weakness and/or the tear away portion can have a semi-circular shape, a circular shape, a triangular shape, an oval shape, a semi-oval shape, a rectangular shape, a square shape, an irregular shape, any other shape, or any combination thereof. Regardless of the shape of the access region or the line of weakness, an upper edge of the access region (but not the line of weakness) follows or makes up a portion of the upper edge of the box.

Lines of weakness can be formed using any available methods. Preferably, lines of weakness can be formed by mechanical cutting; by use of a laser; by degrading a portion of the box using ultraviolet (UV) energy, infrared (IR) energy, Gamma energy, X-ray energy, chemical treatment, thermal treatment, galvanic treatment, other treatments, or any combination thereof; or any combination thereof. Lines of weakness can be formed before the housing is disposed around the inner package, after the housing is disposed around the inner package, or using a combination thereof.

A line of weakness need not be continuous, and can for example include an offset portion. A line of weakness can be described by its thickness. The thickness can describe the thickness of the cut in the box or the depth to which the degradation extends in the box, for example. Some opening portions can include a line of weakness or a portion of a line of weakness that extends through the entire thickness of the box. A line of weakness can also have different depths at different points. A line of weakness can also be described by the force necessary to break the box at the line of weakness. Preferably, a line of weakness, whether the line of weakness is a cut, slit or perforation in the box or degradation of a portion of the box, may require a force not greater than about 12 Newtons to break, preferably, the force is smaller than 6 Newtons to break, more preferably, the force is smaller than 3 Newtons to break.

Breaking the line of weakness of the access region disconnects the tear away portion to afford access to the insert. The tear away portion of the access region can be un-affixed and it can be removed from the container when the line of weakness is broken, the insert can be removed at the same time or later in time. The tear away portion of the access region can be affixed to the insert, so that upon breaking the line of weakness, the tear away portion is attached to the insert and it can be removed from the container along with the insert. The tear away portion of the access region can also be affixed to some portion of or on the lid, for example the label or the flap of the first layer of the inner package. In such embodiments, opening the container, via opening the lid, can remove the tear away portion from the box at the line of weakness and then the insert can be accessed immediately, later in time, or both. The tear away portion can then remain attached to the portion of the lid or can be removed and discarded. The tear away portion of the access region could also be affixed to a portion of an optional outer liner (that covers the entire container). For example, the tear away portion could be affixed to a tear strip of an outer liner that functions to remove at least a portion of an outer liner. In such embodiments, pulling the tear strip of the outer liner would simultaneously remove or allow the removal of at least a portion of the outer film and simultaneously remove the tear away portion of the access region. In such embodiments, opening the outer film, via the tear strip of the outer film, can remove the tear away portion from the box at the line of weakness and then the insert can be accessed via the void where the tear away portion was, once the optional outer film covering has been removed. The tear away portion can then at least momentarily remain attached to the tear strip of the outer film, the outer film itself, or both.

Access regions can have virtually any usable dimensions. Access regions can be described by how far they extend down (towards the bottom wall of the box) from the upper edge of the box, how far they extend along the upper edge of the box, or both for example. For example, the access region can extend not more than about 10 mm down from the upper edge of the box, preferably not more than about 5 mm down from the upper edge of the box, or even more preferably not more than about 2 mm down from the upper edge of the box. For example, the access region can extend not more than about 20 mm along the upper edge of the box, preferably not more than about 12 mm along the upper edge of the box, or even more preferably not more than about 8 mm along the upper edge of the box.

The container also comprises an inner package. The inner package is disposed within the housing of the container. The inner package can be configured to house or hold consumer goods. Illustrative consumer goods can include smoking articles such as elongate smoking articles. Specific illustrative elongate smoking articles can include for example cigarettes, cigars, cigarillos consumer goods such as aerosol-generating articles that heat but not burn tobacco, or combinations thereof.

The inner package can be made of any suitable materials, for example, polymeric materials, metal foils, other materials, or combinations thereof. The inner package preferably comprises polymeric materials such as polyethylene films, polyolefin films, poly lactic acid (PLA) films, or some combination thereof. Preferably, the inner package can comprise a first layer and a second layer that are attached, at least at their peripheries to form a package with an interior volume.

The inner package comprises an access opening that affords access to the consumer goods housed inside when the inner package is opened. The flap of the inner package covers the access opening when the container and the flap are in a closed position. The access opening is at least partially uncovered when the container and the flap are in the open position. The access opening can be cut during manufacturing, for example.

The inner package comprises an access opening that affords access to the consumer goods housed inside when opened. The flap of the inner package covers the access opening when the container and the flap are in a closed position. The access opening is at least partially uncovered when the container and the flap are in the open position. The access opening can be cut during manufacturing, for example. Preferably, the flap forms an S-shape, a curve with at least two turning points when the flap is open.

The inner package also comprises a flap. Preferably, the first layer of a multilayer inner package comprises a flap. The flap can be attached to the inner surface of the lid, via adhesive, or otherwise. In some embodiments, the flap can be attached to the inner surface of the lid with a label comprising one or more adhesive portions.

In some embodiments, the inner package, or preferably the flap comprises or can be coupled to a resealable label. The resealable label can be configured to attach the flap to the inner surface of the lid as well as reseal the inner package. In such an embodiment, when opening the lid and the inner package, a portion of the second layer attached to the flap, the sealing region, are separated from each other along first and second cut lines respectively to reveal the access opening. The resealable label can be attached to the lid using any suitable techniques, for example, mechanical attachment, adhesive, thermal, or ultrasonic bonding. Preferably, the resealable label can be attached to the lid using an adhesive, more preferably a permanent adhesive. The resealable label can be configured to be re-attached to the second layer when the flap and the lid of the container are in the closed position.

The resealable label allows for repeated opening and closing of the inner package to access the consumer goods individually. The resealable label preferably provides sufficient adhesion for the flap to be re-attached at least as many times as there are consumer goods within the inner package. The resealable label preferably enables a consumer to open and reseal the inner package until the package is empty.

The resealable label has an inner surface and an outer surface. The outer surface of the resealable label can be configured to permanently attach the label and in some embodiments the flap of the inner package to the inner surface of the front wall of the lid.

The inner surface of the resealable label can comprise at least an adhesive portion and a non-adhesive portion. The adhesive portion can be such that movement of the lid between open and closed positions simultaneously moves the flap and the access opening of the inner package between opened and closed positions. In the closed position, the flap and label cover the access opening of the inner package and is resealably attached to the inner package by the resealable adhesive. In the open position, the flap and label are at least partially detached from the inner package and the access opening of the inner package is at least partially uncovered or opened. The adhesive portion of the label can utilize an adhesive for example, preferably a pressure sensitive adhesive. The non-adhesive portion of the inner surface of the label can be positioned at the lower end of the label, which will be towards the bottom edge of the lid. The non-adhesive portion can allow for the resealable adhesive portion to be more easily opened.

The container also comprises an insert. The insert can be utilized for communication. The insert can comprise or be made of any suitable materials. For example, the insert can comprise cardboard, paperboard, paper, plastic, metal, or combinations thereof. The insert can be printed thereon for example using any known printing techniques. The insert can be folded in order to increase the available communication space. The insert can be folded longitudinally or transversally or both longitudinally and transversally. Preferably, at least one dimension of the insert (whether in total or once folded), for example, the height of the insert, can be less than the height of the front wall of the box. Preferably, the length of the insert is between the length of the longest longitudinal length of the front wall and the length of the front wall in the area of the access region. Such configurations afford the use of the maximum length of the insert. Preferably, the other dimension of the insert (whether in total or once folded), for example the width of the insert, can be less than the width of the front of the box. Because of the ability to fold the insert, once, twice, or more often the overall surface The insert is positioned between the inner surface of the front wall of the box and the outer surface of the front wall of the inner package. The insert has an upper edge. The upper edge of the insert is accessible via the access region. Preferably, the entire insert is positioned below the bottom edge of the lid when the container is closed. Even more preferably, the entire insert is positioned below the upper edge of the box.

The container can also comprise an optional inner frame disposed within the box. The inner frame can be disposed inside the front wall of the box. Advantageously, an inner frame with a large surface area provided adjacent the front wall of the box increases the structural strength of the container. This is particularly advantageous for subsequent use when the container is no longer full. A container can also optionally include an inner liner. The inner liner can wrap the consumer goods. The inner liner and the consumer goods can collectively be referred to as an inner package. A carton that includes a lid and at least one sidewall can contain multiple containers as described herein.

Containers of the present invention function to both afford a resealable package and access to an insert. In embodiments where the access region is a cut out from the front of the box, the insert can be accessed via the access region without any additional action. In embodiments where the access region includes a line of weakness, breaking or perforating of the line of weakness can afford access to the insert. In embodiments where the tear away portion of the access region is attached to the label, opening the container will tear the line of weakness, the tear away portion will then be attached to the label or lid and access will be granted to the insert. In embodiments where the tear away portion is attached to the insert, breaking the line of weakness will afford access to the insert and removal of the insert will also simultaneously remove the tear away portion. In embodiments where the tear away portion is not attached to anything but is only a portion of the box, breaking the line of weakness will remove the tear away portion and afford access to the insert.

A carton that includes a lid and at least one sidewall can contain multiple containers as described herein. A carton comprises, houses or holds at least one container. A carton can contain only disclosed containers or can contain disclosed containers as well as other items. In some preferred embodiments, a carton comprises, houses or holds from five to ten disclosed containers.

The term "inner surface" is used throughout the specification to refer to the surface of a component of the assembled container that is facing towards the interior of the container, for example towards the consumer goods, when the container is in the closed position. For example, the outer film comprises an inner surface that is facing the housing of the container.

The term "outer surface" is used throughout the specification to refer to the surface of a component of the container that is facing towards the exterior of the container. For example, the outer film comprises an outer surface that is facing away from the housing of the container. It should be noted that the inside or outside surface is not necessarily equivalent to a certain side of a blank used in assembly of the container. Depending on how the blank is folded around the consumer goods, areas that are on the same side of the container can either face towards the inside or the towards the outside of the container.

The terms "front," "back," "upper," "lower," "top," "bottom," and "side" refer to the relative positions of portions of containers according to the invention and components thereof when the container is in an upright position with the lid of the housing in the closed position and the hinge line at the rear of the container. When describing containers according to the present invention, these terms are used irrespective of the orientation of the container being described. The rear or back wall of the container includes the hinge line.

Referring now to the drawings, in which some aspects of the present invention are illustrated.

Figure 1:
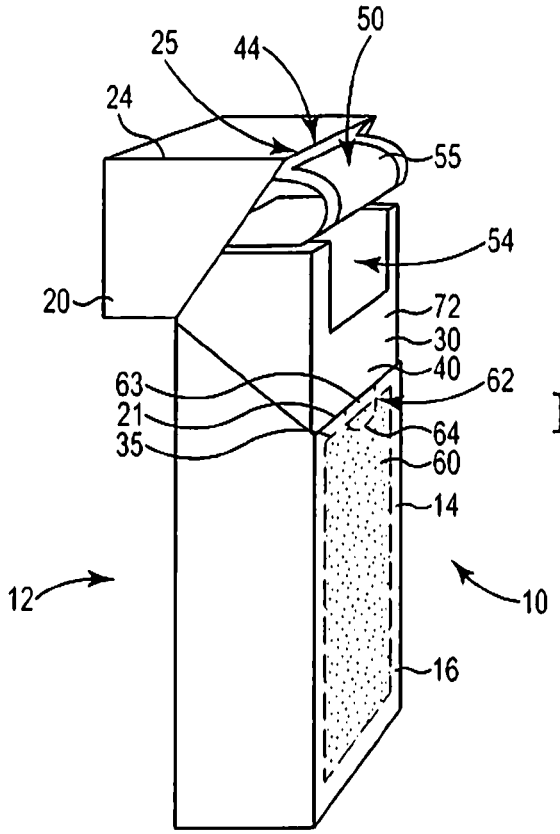
FIG. 1 is a schematic perspective view of a container in an open position, where the container comprises an access region comprising a line of weakness and an insert.

Referring to FIG. 1, a schematic perspective view of an embodiment of a container 10 for consumer goods is depicted. The container includes a housing 12 that includes a box 14 and a lid 20 hingedly attached to the box via a hinge line (not shown). The box has a front wall 16 and a rear wall 18. The front wall of the box has an upper edge 21. The box also has an inner surface 17 and an outer surface 19. The hinge line extends across the back wall 18 of the box 14 of the container 10, and acts to allow the lid 20 to be moved from a closed position (FIG. 3) to an open position as shown in FIG. 1. The lid 20 has a front wall 24 that has an inner surface 22 and an outer surface 26 (FIG. 2).

An inner package 30 is disposed within the housing 12. The inner package 30 at least partially defines an interior volume for housing consumer goods. The inner package 30 is made from a barrier material or materials to hermetically seal the consumer goods before the container is opened for the first time. The barrier material may be a metal foil or a plastic and metal laminate. The inner package 30 includes a front wall 32 and a back wall 34 (seen in FIG. 2). The inner package 30 includes an outer surface 33. The inner package also includes a first layer 40 and a second layer 50 attached to an inner surface of the first layer.

The inner package 30 includes an access opening 54 through which the consumer goods (not shown) can be removed. The access opening 54 is covered by the flap 44 when the flap is in the closed position (FIG. 3). Further, the access opening 54 is at least partially uncovered when the flap 44 is in the open position. The flap can include or be coupled with a label. The label includes a sealing area and a non-sealing area. The flap and the label are not distinguishable in the figures and element 44 can be considered as referring to both of them. The flap 44 can be attached to the first layer 40 along a hinge line 49 (FIG. 2). The flap 44 is also attached to an inner surface 22 (FIG. 2) of the front wall 24 of the lid 20 such that upon opening the lid the flap and a portion 55 of the second layer 50 attached to the flap are separated from the inner package 30 along first and second lines of weakness (not shown herein) to reveal the access opening 54. The flap 44 is adapted to overlap the access opening 54 into a sealing region 72 such that the flap attaches to the second layer 50 within the sealing region 72 when the flap is in the closed position.

Figure 2:
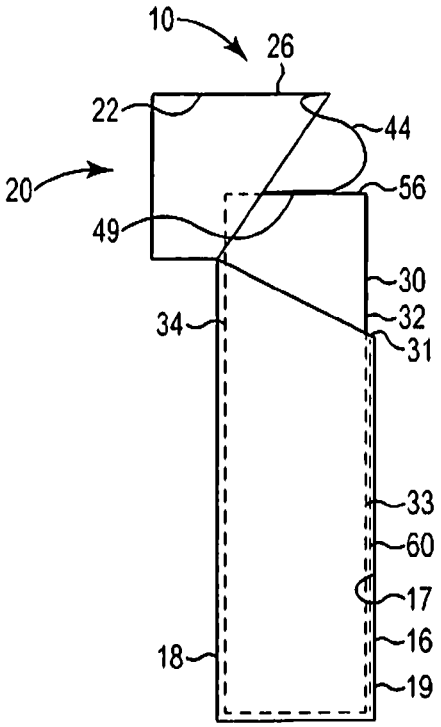
FIG. 2 is a schematic perspective view of the side of the container of FIG. 1 in an open position.
Figure 3:
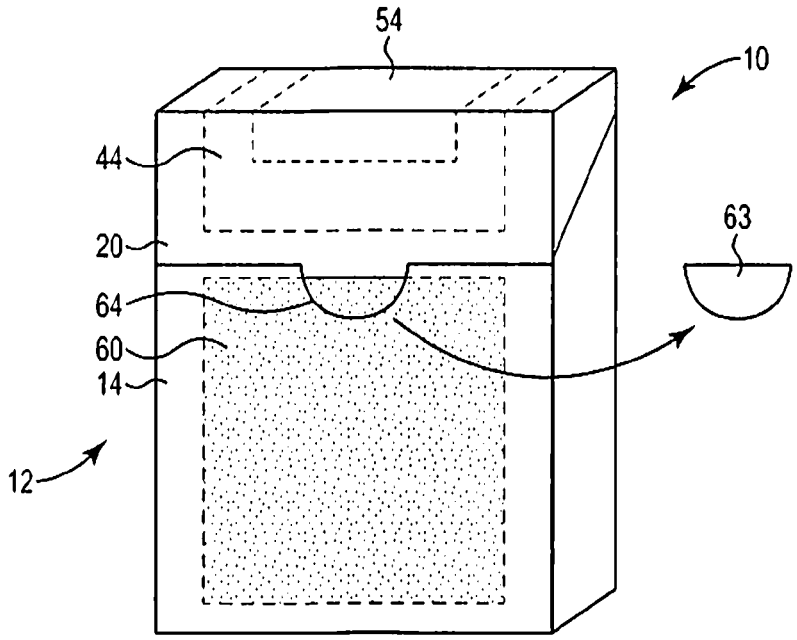
FIG. 3 is a schematic perspective view of the front of the container of FIG. 1 in a closed position.

Referring to FIG. 2, a schematic cross-section view of the container 10 of FIG. 1 is depicted with the lid 20 and the flap 44 in the open position. The inner package 30 is shown disposed within the box 14 of housing 12. The flap 44 is attached to the lid 20. In the open position, the flap 44 forms an S-shape. The geometry of the container 10 is such that the flap 44 is automatically resealed to the inner package 30 when the flap (and the lid 20) is returned to the closed position.

Figure 4:
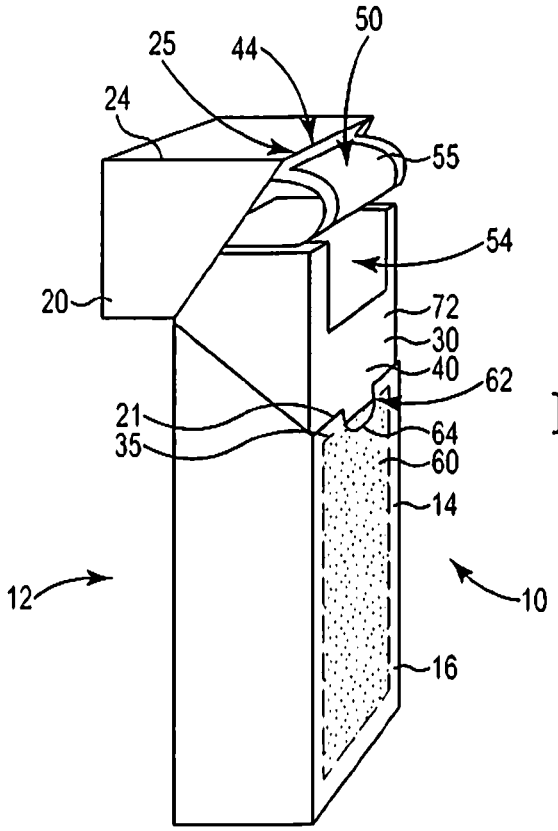
FIG. 4 is a schematic perspective view of a container in an open position, where the container comprises an access region and an insert.

Referring to FIG. 3, a schematic perspective view of the container 10 of FIG. 1 is depicted. The lid 20 of the container 10 and the flap 44 of the inner package 30 are in the closed position. The flap 44 is attached to the second layer 50 (FIG. 4) when the flap is in the closed position.

All of the figures also show an insert 60. The insert 60 is positioned between the inner surface 17 of the front wall 18 of the box and the outer surface 32 of the front wall 31 of the inner package 30. The insert has an upper edge 35 that is accessible via an access region 62. The insert can be made of any useful material, can have any useful dimensions, and can optionally be folded either transversally or longitudinally or both longitudinally and transversally. The entire insert 60 is positioned below the bottom edge 25 of the lid when the container 10 is closed.

Disclosed containers also include an access region 62. The access region 62 can be a portion of the front wall 16 of the box 14 that is cut or notched out or it can include a line of weakness and a tear away portion. In the embodiment depicted in FIG. 1, the access region 62 includes a line of weakness 64 and a tear away portion 63. In the embodiment depicted in FIG. 4, the access region 62 is cut out of the front wall 16 of the box 14. Such an access region affords egress and ingress of the insert 60 without additional action or modification of the container.

FIG. 3 shows the container 10 of FIG. 1 in a closed state. The access region in this container included a line of weakness 64 and a tear away portion 63. The line of weakness 64 has already been broken or perforated and the tear away portion 63 removed to afford access to the insert 60. The tear away portion 63 in this embodiment was not affixed to any portion of the container so that once the line of weakness was broken, the tear away portion 63 was entirely free of the container 10.

Figure 5:
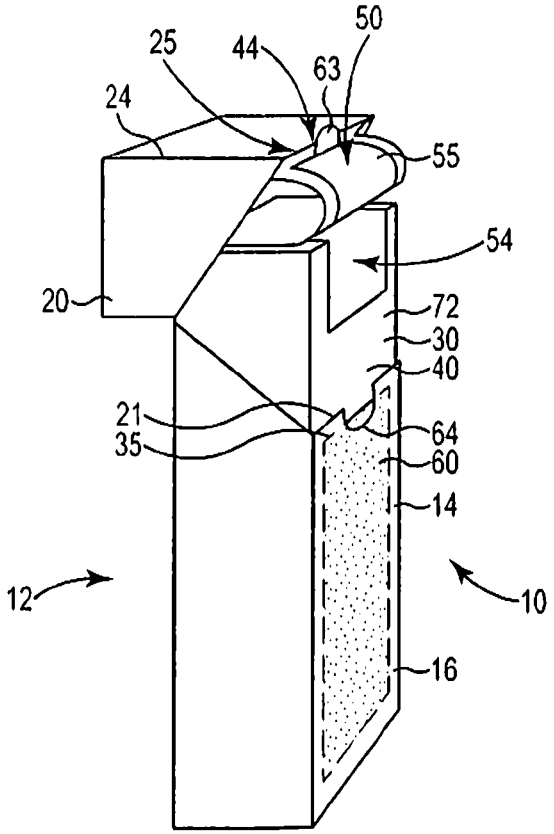
FIG. 5 is a schematic perspective view of a container in an open position, where the container comprises an access region comprising a line of weakness and an insert.

In the embodiment depicted in FIG. 5, the tear away portion of the access region 62 was affixed to the label 44. When the container 10 was opened, the tear away portion 63 of the access region 62 was removed and remains affixed to the label 44. The insert 60 is now accessible.

Figure 6:
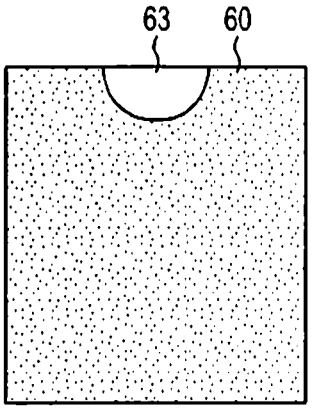
FIG. 6 is a schematic view of an insert with a tear away portion attached thereto.

FIG. 6 shows an insert 60 that could have been removed from the embodiment of FIG. 1. In this embodiment, the tear away portion 63 was affixed to the insert 60. Once the line of weakness 64 of the access region 62 was broken, the tear away portion 63, affixed to the insert, was pulled out of the container 10 along with the insert 60.

The invention claimed is:

1. A container (10) for consumer goods, comprising:

a housing (12) comprising a box (14) and a lid (20) hingedly attached to the box, the lid comprising a front wall (24), wherein the front wall of the lid has an inner surface (22), an outer surface (26) and a bottom edge (25), the box comprising a front wall (16), wherein the front wall of the box has an upper edge (21);

an inner package (30) disposed within the housing and at least partially defining an interior volume for housing consumer goods, the inner package having an outer surface, the inner package comprising a first layer (40) and a second layer (50), the first layer comprising a flap (44), the flap attached to the inner surface of the lid and the flap configured to be resealably attached to a sealing region (72) of the second layer to open and close the inner package by opening and closing the lid, and wherein the inner package has a front wall; and an insert (60) positioned between the inner surface of the front wall of the box and the outer surface of the front wall of the inner package, the insert having an upper edge (35), the container characterized by the front wall of the box having an access region (62), wherein at least some portion of the upper edge of the box is formed by at least some portion of the access region, the upper edge of the insert being accessible via the access region, and the entire insert being positioned below the bottom edge of the lid when the container is closed.

2. The container of claim 1, wherein the access region has a semicircular shape, a circular shape, an oval shape, a semi-oval shape, a triangular shape, a rectangular shape, a square shape, an irregular shape, or some combination thereof.

3. The container of claim 1, wherein the access region comprises a portion of the front wall having a line of weakness (64) and a tear away portion (63).

4. The container of claim 3, wherein the tear away portion is removed from the container along with the insert.

5. The container of claim 4, wherein the tear away portion is affixed to the insert.

6. The container of claim 4, wherein the tear away portion is not affixed to the insert.

7. The container of claim 3, wherein the tear away portion is affixed to the flap of the first layer of the inner package, the lid of the container, or both.

8. The container of claim 7, wherein the tear away portion is removed when the container is opened the first time.

9. The container of claim 1, wherein the upper edge of the box comprises a semicircle portion that forms the access region.

10. The container of claim 1, wherein the access region extends not more than 10 millimeters down from the upper edge of the box.

11. The container of claim 1, wherein the access region extends not more than 20 millimeters along the upper edge of the box.

12. The container of claim 1 further comprising the consumer goods, wherein the consumer goods are housed in the interior volume defined by the inner package.

13. The container of claim 1, wherein the consumer goods are smoking articles.

14. A carton comprising a lid and at least one sidewall, the carton containing at least one container of claim 1.

* * * * *